US007186316B1

(12) United States Patent
Ryu et al.

(10) Patent No.: US 7,186,316 B1
(45) Date of Patent: Mar. 6, 2007

(54) METHOD FOR PREPARING PULP FROM CORNSTALK

(75) Inventors: Haiil Ryu, Yuseong-Gu (KR); Chul Kap Kim, Osan-Si (KR); Jong-Myoung Won, Chuncheon (KR)

(73) Assignee: CP & P Co., Ltd., Seoul (KR)

( * ) Notice: Subject to any disclaimer, the term of this patent is extended or adjusted under 35 U.S.C. 154(b) by 0 days.

(21) Appl. No.: 10/312,440

(22) PCT Filed: Jun. 29, 2000

(86) PCT No.: PCT/KR00/00681

§ 371 (c)(1),
(2), (4) Date: Mar. 24, 2003

(87) PCT Pub. No.: WO02/00995

PCT Pub. Date: Jan. 3, 2002

(51) Int. Cl.
*D21H 11/12* (2006.01)
*D21C 3/02* (2006.01)

(52) U.S. Cl. ..... 162/96; 162/72; 162/86; 162/90

(58) Field of Classification Search ..... 162/96–99, 162/83, 90, 76, 26, 82, 84, 86, 91
See application file for complete search history.

(56) References Cited

U.S. PATENT DOCUMENTS

| | | | | |
|---|---|---|---|---|
| 1,845,487 | A | 2/1932 | Darling et al. | |
| 1,846,511 | A * | 2/1932 | Darling | 162/24 |
| 1,846,672 | A * | 2/1932 | Bradley et al. | 162/36 |
| 2,068,151 | A * | 1/1937 | Remler | 162/72 |
| 2,625,474 | A | 1/1953 | Atkinson, Jr. et al. | |
| 2,924,547 | A | 2/1960 | Knapp et al. | |
| 3,013,935 | A | 12/1961 | Henderson et al. | |
| 3,666,620 | A | 5/1972 | Wright | |
| 4,012,280 | A * | 3/1977 | Holton | 162/65 |
| 4,239,906 | A | 12/1980 | Antrim et al. | |
| 4,260,452 | A | 4/1981 | Kruger et al. | |
| 5,554,330 | A | 9/1996 | Flannery et al. | |
| 5,620,565 | A | 4/1997 | Lazorisak et al. | |
| 5,944,953 | A * | 8/1999 | Lavoie et al. | 162/96 |
| 6,302,997 | B1 * | 10/2001 | Hurter et al. | 162/65 |
| 6,348,127 | B1 * | 2/2002 | Gallagher et al. | 162/18 |

FOREIGN PATENT DOCUMENTS

| | | | |
|---|---|---|---|
| CA | 2171681 | | 9/1977 |
| CN | 1062939 | | 7/1992 |
| CN | 1071361 | | 4/1993 |
| CN | 1131713 | | 9/1996 |
| CN | 1131713 | A | 9/1996 |
| CN | 1293284 | | 5/2001 |
| EP | 00940984.8 | | 8/2006 |
| JP | 04-057982 | | 2/1992 |
| JP | 04-146282 | | 5/1992 |
| JP | 06146194 | A | 5/1994 |
| JP | 06146194 | A * | 5/1994 |
| JP | 09-059886 | | 3/1997 |
| JP | 04057982 | A | 9/1997 |
| JP | 09241984 | A | 9/1997 |
| JP | 10-511147 | | 10/1998 |
| JP | 10-325090 | | 12/1998 |
| JP | 10-331084 | | 12/1998 |
| JP | 2002506300 | | 2/2002 |
| KR | 00/00681 | * | 1/2002 |
| WO | WO 96/35013 | | 11/1996 |
| WO | WO 99/41448 | | 8/1999 |
| WO | WO02/00945 | * | 1/2002 |

OTHER PUBLICATIONS

Saturated Steam, Jan. 31, 2006, www.spiraxsarco.com/EscSS_Properties.aspx?country_id=HQ&lang_id=ENG.*
Smook, G.A., Handbook for Pulp & Paper Technologists, TAPPI, 1982, pp. 190-191 & 204-205.*
Partial Korean Patent Publication, Sep. 20, 1965, Lim.
Lyle J. Gordon, Section 3-3 entitled Sulfite Pulping, Handbook of Pulp and Paper Technology, 2nd Edition, pp. 159-165.
Wang, Ping, et al, "Preliminary experiment of Pulping and Papermaking by Using Flesh Texture-Removed Cornstalk", Liaoning Papermaking, No. 2, 1997.
Pan, Hansong, "New Progress of Research and Application of Polyacrylamide", Guangzhou Chemical Industry, vol. 23, No. 3, 1995.
Ye, Xiaochun, "Cationic Starch and its Use in Papermaking Industry", North Papermaking, No. 3, 1994.
Notification of First Office Action from Chinese Patetn Office, dated Oct. 29, 2004.

* cited by examiner

*Primary Examiner*—Eric Hug
(74) *Attorney, Agent, or Firm*—Godfrey & Kahn, S.C.

(57) ABSTRACT

Disclosed is a method for preparing paper pulp from cornstalks comprising the steps of cooking, washing, screening, thickening, bleaching, beating and drying performed under moderate conditions which have little noxious effects on the environment. By using cornstalks as raw materials for paper pulp, it becomes possible to replace import of wood raw materials, to save foreign currency, to increase rural income, and to make high quality paper.

5 Claims, No Drawings

METHOD FOR PREPARING PULP FROM CORNSTALK

BACKGROUND OF THE INVENTION

The present invention relates to a pulp making technology using herbaceous plants, more particularly, to a method for making pulp from cornstalk.

Using cornstalk as a raw material for pulp making can replace import of raw wood material, so that it can save foreign currency, increase rural income and make high-quality paper.

At present, Korea, with increasing national income, is a tenth manufacturing country in the world (paper and board production of 5,830,000 tons/year) as well as a seventh paper consuming country, in publications, newspapers, boards for publishing, graft papers and bulk papers. Total amount of pulp to prepare papers, however, entirely (100%) depends on foreign markets. Because developing pulp industries will impair forest resources, new pulp materials should be developed. To do so, we should manufacture and process cellulose materials from various plant species and improve their utility value. Species of trees in Korea are not proper for pulp making, domestic wood production for pulp preparing is not enough, and thus raw materials for pulp making can't be secured. Therefore studies to find new turning point in terms of pulp making are frequently reported.

Conventionally, pulp for paper-making is mostly from wood. However, as recently worldwide shortage of wood resources is deepened, it has become a big issue to manufacture pulp and paper without destroying forests and environment. As a plan to solve this problem, technologies of pulp making from non-wood plant fibers, using one or two years plants as main materials, have been taken notice. To ensure providing materials for pulp making, in China, Middle Ease and India, which face the shortage of forests resources, national-widely tend to concentrate on developing pulp material using herbs such as bamboos and farm wastes, and developing pulp manufacturing processes using wastes of sugar canestalks abolished after sugar production.

Generally, non-wood plants tend to contain lots of pectin, hemi-celluloses and inorganic substances, but a little bit of lignin. In order to make pulp from non-wood plant, chemical, semi-chemical or mechanical methods are used, and unbleached or bleached pulp can be obtained under very mild conditions compared with wood materials. Each non-wood pulp has different characteristics according to its fiber form, chemical composition, and types and amount of non-fiber cells. Therefore, papers manufactured from non-wood pulp alone or appropriately combined with wood pulps have used in more various usages according to strength, permanence, electrical characteristics, luster, dimension stability and feature of publishing performance, and their utilizations have been extended.

Paper mulberry inner bark, flax, hemp, cotton plant, Manila hemp, and etc. are examples of non-wood plants. There have previously been attempts in the art to provide pulp manufacturing methods using bagasses (as disclosed in Korean Patent Laid-open No. 84-005762), dry pine needles gathered from fallen leaves (in Korean Patent Laid-open No. 91-3216), or rice stalks (in Korean Patent Laid-open Nos. 98-9651 and 93-2604), as law materials for pulp making. In addition, Korean Patent Application No. 85-5895 discloses a method for preparing pulp from cigarette stalks.

To the inventor's knowledge, a method for preparing pulp from cornstalks has not been recognized in any document, nor mentioned in any report to date.

Corn cultivated in rural district is used for food or livestock feed. Most cornstalks are crushed and scattered to fertilize the soil, although some of those are used as a livestock. It is seriously required to find the alternative raw materials for preparing pulp, so as to minimize unnecessary foreign currency waste, and need to use farm wastes usefully to increase rural income. There is also a need of developing high-quality paper. Therefore, it is necessary to process cornstalks in novel way and raise their utility value in making pulp or other pulp-like materials.

Now, the present invention made an attempt to prepare a novel and peculiar pulp from cornstalks and manufacture the paper having high-quality and unique characteristics. At present, because paper making and dissolving pulp is prepared by separating fibrous cellulose from wood sources in most of countries, more than 90% of pulp production in the world are wood pulps.

Koreans have been long produced Korean paper from paper mulberry barks, as a Korean pure specialty having peculiar characteristics distinct from western paper in terms of physical properties. Korean paper is much superior in terms of durability, heat insulation and air permeability. In conventional Korean paper preparation, paper mulberry barks are collected in every October and November, boiled in a kettle, and debarked to leave white inner bark alone. The outer barks are boiled well in the buckwheat lye and mashed by beating with a wooden hammer so as to be softened. Then, the obtained paper mulberry juice is added into a paper peeling tank to obtain paper sheets.

In the manufacture of a wood-based cellulose pulp, it is necessary to develop a selective reagent reactive not to celluloses but to lignin under exposure to the timber. Since the pulp making process is a combination of wastewater recovery and waste treatment processes in terms of environment conservancy, the wood pulp manufacturing industry is considered as a capital-intensive large-scaled equipment and an energy-intensive industry using a large amount of water.

The chemical pulp preparation is composed of a pulping step for removing lignin among wood ingredients, and a pulp bleaching and purifying step for selectively eliminating residual impurities in pulp. The chemical pulp preparation method considerably varies depending on the usage and required quality of the final pulp product. The conventional pulp used for paper manufacturing is made from softwood and hardwood. Such raw materials are processed into wood pulp by mechanical, chemical and semi-chemical methods. The mechanical pulping process consists of debarking, cutting, grinding, coarse screening, fine screening, centrifugal cleaning, thickening, bleaching, washing, drying and packing. Meanwhile, the chemical pulping process consists of debarking, chipping, cooking, coarse screening, fine screening, washing, centrifugal cleaning, thickening, bleaching, drying and packing.

Specifically, there are two types of pulp, paper-making pulp and dissolving pulp. The dissolving pulp is prepared by the pre-treatment and chemical pulping to get high purity cellulose product and used for the manufacture of various cellulose polymer products and preparation of cellulose derivatives having high alpha-cellulose content of 90–98%. Semi-chemical pulping process consists of mild chemical treatment and mechanical defibering process to separate pulp fiber.

In a kraft method, for removing lignin from timber, nucleophilic groups such as —OH, —SH and —$S_2$ in alkaline cooking liquor attack the lignin polymer constituted by phenylpropane units to produce phenol hydroxyl groups, quinonmethide formed thereby reacts with the neucleophilic reagent to generate a sulfurization reaction, and then the lignin polymer is degraded to be dissolved in the alkaline solution. In an acidic sulfite method, phenolic ether bonds are hydrolyzed by $H^+$ to produce, bisulfite ions bind to carbonium ions, and the lignin polymer is converted to water-soluble lignosulfate. However, in the methods using a cooking reagent selectively reactive to lignin polymer rather than other polymer ingredients of the wood, cooking liquor is a strong alkaline or acid solution. Also, high-purity fibrous celluloses cannot be separated by those methods, because parts of the celluloses are decomposed at high temperature controlled in the range of about 150–170° C. to achieve an economical lignin separation rate. Accordingly, considering pulp yield and economical aspects, the paper making pulp must be subjected to a bleaching step to obtain high level of brightness through a selective removal method for residual lignin comprising at least five-stage oxidation and/or reduction, and alkaline extraction.

SUMMARY OF THE INVENTION

The present invention is contrived to provide a method for preparing pulp with good quality from cornstalks, whereby the cornstalks can be used to prepare high quality pulp as substitution for the conventional wood pulp. The pulp preparing method further includes a bleaching step.

The present invention is also to provide a method for preparing pulp from cornstalks, in which other pulp such as wood pulp, recycled pulp or other herbaceous pulp, can be additionally added.

DETAILED DESCRIPTION OF THE INVENTION

The present invention is directed to pulp preparing method using herbaceous plants and, specifically, to a method for preparing pulp from cornstalk.

The raw material used in the present invention, corns are classified into eight species; dent corn, flint corn, sweet corn, pop corn, flour corn, starchy sweet corn, waxy corn and pad corn, depending on the shape and property of the grain. Fruits of corns are used as food, and ensilages of stalks and leaves thereof loosely cut off are used as animal feed. Besides, the corns are utilized as construction materials, fuel, filler, mat, straw sandals, medical stuff, and so forth.

The conventional main source of pulp, timber is a tree grown with cells accumulated by the cell division. In timber, microfilaments are densely arranged in an alternative manner in lignin matrix having a structure similar to concrete structure, and partially associated with each other by chemical bonds to strengthen the timber. Feudenberg et al. analyzed degradation products of timber through hydrolysis, pyrolysis, replacement, oxidation and reduction, and found that timber has a distinct structure depending on the type of the source of timber; softwood, hardwood, or herbaceous plant. Softwood is used as an industrial material, and its usefulness as an industrial material relies on the structure of lignin units existing in cell walls and the type of tree.

In regard to composition, cornstalk of the present invention contains hemi-cellulose in the highest content and lignin in low content, while the wood has the highest cellulose content and high lignin content. For example, the wood comprises 45 wt. % of cellulose, 27 wt. % of hemi-cellulose, 28 wt. % of lignin, and 3 wt. % of other extractives. The cornstalk has filaments 1–4 mm long, 20–40 μm in width and 5–10 μm in thickness.

The present invention is contrived to provide a cornstalk pulp preparing method comprising the steps of pulverization, cooking, beating, paper making and drying. This preparation method of cornstalk pulp is much analogous to that of wood pulp, but requires less severe conditions to obtain pulp, considering low lignin content and so on. However, the cornstalk pulp takes somewhat long time in manufacturing relatively, compared with other herbaceous pulp.

The cornstalk pulp preparing method may further include a pulp bleaching step, generally using an oxidizing and/or reducing agent as a pulp bleaching agent. The method may further include a chlorination step using chlorine only in the first stage of the process in order to remove residual lignin. The chlorination step makes the lignin hydrophilic through reaction with an unsaturated aliphatic compound, fluorogum chemicals or resinate. After the chlorination step, a thermal alkaline extraction step, which involves alkaline saponification of fatty acid, wax and other esters into free fatty acid in the form of soap, is performed. The fatty acid dissolves fluorogum chemicals and decomposes lignin fragments. One of the most effective surfactants used in the alkaline extraction step is nonylphenol having polyethylene having a branched chain of glycol. Like wood pulp, the cornstalk pulp is subjected to hypochlorite bleaching, chlorine dioxide bleaching or hydrogen peroxide bleaching in order to improve brightness.

Wood pulp, herbaceous pulp or recycled pulp may be added to cornstalk pulp in order to improve and/or provide various properties.

Alternatively, a water-soluble polymer material may be added to the pulp composed of the cornstalks only or further comprising another pulp, for the purpose of enhancing the property of pulp. The water-soluble polymer may be preferably polyvinylalcohol or polyacrylamide. The reason for adding such water-soluble polymer to pulp is to improve surface conditions and paper strength, expand the usage and provide water resistance.

In the pulp preparation, additional ingredient materials, such as starch, paper strength enhancer, fiber expansion agent, fluorescent brightener or polymer electrolyte, may be added. Preferably, examples of the polymer electrolyte may include polyamine, polyethylene amine, polyethylene oxide, etc. The polymer electrolyte prevents entanglement and disperses pulp. The other additives make the structure of pulp dense and provide fiber expansion, printability and opaqueness of the paper, as well as lower the production cost of the paper. Examples of the other additives may include aluminum sulfate, calcium carbonate, China clay, aluminum hydroxide, diatomaceous earth, lipid glucose, talc, carboxymethylcellulose, diethylamine ethyl chloride, gum rosin, wood rosin, and the like.

Among the pulp preparation steps, the high-pressure cooking step preferably may use pressurized pulping methods such as kraft pulping, sulfite pulping, alkaline sulfite pulping or soda pulping, because paper making is not executable by an atmospheric pulping method. By the atmospheric pulping method, the keratin layer and the inner fiber of the cornstalks can not be sufficiently cooked and a considerable loss of a cooking reagent may be occurred in the process of the test.

The reaction conditions of the high-pressure cooking step are almost the same in the four above-mentioned pulping methods, excepting the type of the reagent. For example, the alkaline sulfite pulping method and the soda pulping method are performed under the same conditions, but using different reagents. The kraft pulping method uses an aqueous solution of NaOH and $Na_2S$, the sulfite pulping method an aqueous solution of $Na_2SO_3$ and $Na_2CO_3$, the alkaline sulfite pulping method an aqueous solution of NaOH, $Na_2$ $SO_3$ and AQ (anthraquinone), the soda pulping method an aqueous solution of NaOH alone.

The high-pressure cooking is preferably carried out under the following conditions: the reaction time of 1.5 to 4 hours; the reaction temperature of 120 to 200° C.; and the ratio (wt/wt) of the aqueous solution of the reagent to the pulp material in the range of 6:1 to 3:1. If the ratio (wt/wt) of the aqueous solution of the reagent to the pulp material exceeds the above range, the extremely strong chemicals makes all weak celluloses melted and remains strong fibers to increase the paper strength. Thus the ratio of the aqueous solution of the reagent to the pulp material must be adjusted to such an adequate level as to meet the economic requirements.

The collected cornstalks are removed of the flesh texture, subjected to pulverizing and defibrating to achieve fiber cooking and, after removal of the keratin layer and other impurities, dispersed through beating. Subsequently, papers are made by forming shape of paper sheets from the dispersed pulp using a sheet machine, sizing and drying.

Each paper manufactured by soda pulping, kraft pulping or alkaline sulfite pulping was measured for their physical properties.

The specific volume was largest for the soda-treated pulp made of cornstalks alone, which showed that the fibrous structure of the soda-treated pulp was very soft and defibrated to bulky structure. A tensile strength test revealed that the kraft pulp was most superior in the tensile strength and best cooked. Such results demonstrated that the kraft pulp was mostly composed of fibrous tissue. The kraft pulp was most superior in the bursting strength and the folding endurance and the alkaline-sulfite pulp has the highest tearing strength, to other pulps.

TABLE 1

| Items | Bleached Soda Pulp | Bleached Kraft Pulp | Bleached Alkaline-Sulfite Pulp | Softwood Bleached Kraft Pulp (SwBKP) |
|---|---|---|---|---|
| Specific Volume ($m^3/g$) | 2.15 | 1.87 | 1.92 | 2.12 |
| Tensile Index (Nm/g) | 17.52 | 28.82 | 23.12 | 39.40 |
| Burst Index (KPa · $m^2/g$) | 0.08 | 0.15 | 0.12 | 0.41 |
| Folding Endurance (double fold no.) | 1.33 | 2 | 1.67 | 4.36 |
| Tear Index (mN · $m^2/g$) | 0.43 | 0.41 | 0.46 | 2.59 |

Each paper sheet prepared by mixing 40 wt. % of cornstalk soda pulp, cornstalk kraft pulp or cornstalk alkaline-sulfite pulp with about 60 wt. % of softwood bleached kraft pulp (SwBKP) was much superior in physical properties to pulp made of cornstalks alone. The three pulps of soda pulp, kraft pulp and alkaline-sulfite pulp mixed with SwBKP showed almost two-fold specific volume and burst index, at least about seventy-fold folding endurance and at least five-fold tear index, compared with pulp made of cornstalks alone. This suggests the characteristics, economic worth and expectation of infinite development of pulp made of cornstalks.

TABLE 2

Properties of Paper Sheets Comprising NBKP (60 wt. %) and Cornstalk Bleached Pulp (40 wt. %).

| | Bleached Soda Pulp | | Bleached Kraft Pulp | | Bleached Alkaline-Sulfite Pulp | | Softwood Bleached Kraft Pulp (SwBKP) | |
|---|---|---|---|---|---|---|---|---|
| Items | A | B | A | B | A | B | A | B |
| Fiber Composition (wt. %) | 60 | 40 | 60 | 40 | 60 | 40 | 60 | 40 |
| Specific Volume ($m^3/g$) | 1.98 | | 1.89 | | 1.98 | | 2.12 | |
| Tensile Index (Nm/g) | 32.58 | | 36.27 | | 34.42 | | 39.40 | |
| Burst Index (KPa · $m^2/g$) | 0.27 | | 0.27 | | 0.29 | | 0.41 | |
| Folding Endurance (double fold no.) | 77 | | 85 | | 78 | | 4.36 | |
| Tear Index (mN · $m^2/g$) | 1.69 | | 2.08 | | 1.52 | | 2.59 | |

Note)
A: SwBKP
B: cornstalk

BEST MODE FOR CARRYING OUT THE INVENTION

The present invention will be described below in further detail with reference to the following examples, in order to illustrate but not to be intended to limit the present invention.

Reagent and Material

In the present invention, NaOH, $Na_2SO_3$, $Na_2S$ and $Na_2CO_3$ were used as cooking agents and sodium hypochlorite (NaClO) and calcium hypochlorite ($Ca(ClO)_2$) were used as bleaching agents.

Cornstalks harvested on the farm and completely dried in the shadow were used as the raw material for pulp. The dried cornstalks were cut off in 3–4 cm, removed of leaves and other unnecessary parts from the outer skin, split to remove the inner skin, i.e., flesh texture, and then pulverized in a regular size through a crusher and a grinder.

As apparatuses for the pulp preparation, a 3-liter beaker, a heating plate, a magnetic stirrer and a double boiler were used under atmospheric conditions, and a 10 $kg/cm^2$ heated pressure vessel was used with shaking under the pressurized conditions. An automatic shaking apparatus was used for washing and neutralization, and a special apparatus for pulverization of the liquid pulp material. A PFI-milling machine (beating conditions: selecting pressure 1.8 $kg/cm^2$, clearance 0.3 mm) was used for pulp beating and a specific standard sheet machine (Hand sheet machine, TMI Inc., 173 mm in diameter) for making sheets from pulp. Herein, the radius of a pouring basin was 17.3 cm and the hole size of a sieve was 0.38–0.39 mm A thick non-woven fabric, a pushing rollers and a double cylinder type mechanism were used for giving the form of the prepared paper sample and preventing a wrinkle on the dry surface of the paper sample. The characteristics of pulp were measured with a specific volumenometer and a tensile strength tester (Schopper type, Toyo seik Inc.), a bursting strength tester (Mullen type, B. F. Perkin Inc.), a folding endurance tester (MIT Fordering Endurance Tester, Timus Olsen testing machine Inc.) and a tearing strength tester (Elmendorf Tearing Tester, Thwing Alert Instrument Inc.).

COMPARATIVE EXAMPLE 1

In the atmospheric experiment, 100 g of cornstalk sample (removed of flesh texture) was tested using NaOH with a concentration of 10% and $Na_2SO_3$ with a concentration of 15% in the temperature range of around 150° C. for 2, 3 and 4 hours, respectively. After filtering the cooked sample with a 100 mesh sieve, the residual was settled in water for about one day to be neutralized, and dried at 80° C. for 5 days. The dried product was used as pulp material. In the present invention, the amount of the obtained product was 65.4 g, 63.2 g and 62.3 g when treated with 15% NaOH at 150° C. for 2, 3 and 4 hours, respectively; and 68.34 g, 65.12 g and 62.7 g when treated with 15% $Na_2SO_3$ at 150° C. for 2, 3 and 4 hours, respectively. Thus, the yield amounted to about 65%. A hundred (100) g of the cooked sample was filtered with a 100 mesh sieve and the residual was settled in water for about one day, followed by beating. The final product was intended to use as pulp material, but the paper was not made therefrom.

To calculate the yield of pulp, the cornstalk sample was cooked under the respective pulping conditions, washed, defibrated with a pulp disintegrator at 3,000 rpm, dried at 80° C. for 5 hours and weighted. The yield of pulp is calculated by the following equation.

$$\text{Yield (\%)} = \frac{\text{dry weight of the obtained product}}{\text{dry weight of cornstalk removed of flesh texture}} \times 100$$

EXAMPLE 1

In the high-pressure cooking step of the present invention, 500 g of cornstalk sample was added into an electrical heater type rotary cooking machine (selecting pressure 0–10 kg/cm$^2$, temperature 0–200° C., capacity 40 liters) and subjected to cooking at a liquid ratio (wt/wt) of 4:1 to 6:1 (weigh of cooking aqueous solution to dry weight of sample) and the maximum cooking temperature of 150° C. for 1.5 to 4 hours, according to the soda pulping method.

Specifically, in the first step of the soda pulping method, 500 g of the sample was added into an electrical heater type rotary cooking machine (selecting pressure 0–10 kg/cm$^2$, temperature 0–200° C., capacity 40 liters) and treated with 15% NaOH at a fixed liquid ratio (wt/wt) of 4:1 (aqueous solution to dry weight of sample) and the maximum cooking temperature of 150° C. for 1.5 hour. It was found that the nodes of the cornstalk were not well cooked and restored to the original state, which made it difficult to use the resulting material as pulp. However, in the second step of the soda pulping method, 500 g of the sample was added into an electrical heater type rotary cooking machine (selecting pressure 0–10 kg/cm$^2$, temperature 0–200° C., capacity 40 liters) and treated with 20% NaOH at a fixed liquid ratio (wt/wt) of 6:1 (aqueous solution to dry weight of sample) and the maximum cooking temperature of 150° C. for 3 hours. As a result, the cornstalk was well cooked into pulp with the yield of 21–35 wt. %.

EXAMPLE 2

The cornstalk sample was subjected to soda pulping using a first cooking liquid of 14% $Na_2SO_3$ and 4% $Na_2CO_3$ at a fixed liquid ratio (wt/wt) of 4:1 (aqueous solution to dry weight of sample) and the maximum cooling temperature of 150° C. for 2 hours. The cornstalk sample was not well cooked into a pulp. Meanwhile, the cornstalk sample was subjected to soda pulping using a second cooking liquid of 28% $Na_2SO_3$ and 8% $Na_2CO_3$ at a fixed liquid ratio (wt/wt) of 6:1 (aqueous solution to dry weight of sample) and the maximum cooling temperature of 150° C. for 4 hours. As a result, the cornstalk sample was well cooked into a pulp with the yield of about 26–41 wt. %.

EXAMPLE 3

The same procedures as described in Example 1 were performed excepting that 500 g of cornstalk was subjected to soda pulping using a cooking liquid of 10% NaOH, 20% $Na_2SO_3$, 4% $Na_2CO_3$ and 0.1% anthraquinone at a fixed liquid ratio (wt/wt) of 6:1 (aqueous solution to dry weight of sample) for 3 hours. The yield of the pulp was about 23–38 wt. %.

EXAMPLE 4

The same procedures as described in Example 1 were performed excepting that 500 g of cornstalk sample was subjected to kraft pulping, using cooking liquor of 20% NaOH and 15% $Na_2S$, at a fixed liquid ratio (wt/wt) of 6:1 (aqueous solution to dry weight of sample) for 1.5 hour. The yield of the obtained pulp was about 25–32 wt. %.

EXAMPLE 5

First Beating and Paper Making

Thirty (30) g of the pulped dry sample was settled in water with the concentration of 10% (wt/wt) for at least 2 hours, added to a beating machine-PFI mill (beating conditions: selection pressure 1.8 kg/cm$^2$, clearance 0.3 mm), and then, applied 500 revolutions in the case of kraft pulp and 1100 revolutions in the case of alkaline sulfide pulp to get 40□SR.

EXAMPLE 6

Pulp Bleaching

Sodium hypochlorite (NaClO) and calcium hypochlorite ($Ca(ClO)_2$) were used as a bleaching agent and sodium hydroxide and sodium silicate were added to adjust the pH in the range of pH 9–11. The pulp concentration was in the range of 4–6% at the reaction temperature of 40° C. and 10–16% at 35° C.

Following the pulp bleaching step, the remaining alkaline component was extracted with the pulp concentration of 10–20% at 45–80° C. for 1 to 2 hours.

The pulps obtained in the above examples were processed into paper sheets using a special sheet machine (Hand Sheet Machine, TMI Inc., 173 mm in diameter).

EXAMPLE 7

The four different pulps, i.e, soda pulp, kraft pulp, alkaline sulfite pulp and sulfite pulp prepared in the above examples were measured for their physical properties. To enhance the physical properties and extend the usage of the cornstalk pulp, each 40 wt. % of the individual pulp were mixed with about 60 wt. % of bleached kraft pulp from softwood. Thereafter, the pulp samples were measured in regard to specific volume, tensile strength, bursting strength, folding endurance and tearing strength. The results are presented in Tables 1 and 2.

As described above, the present invention provides a pulp preparing method, specifically, a method for preparing paper pulp from cornstalks comprising the steps of cooking, washing, screening, thickening, bleaching, beating and drying, performed under moderate conditions which have little noxious effects on the environment. By using cornstalks as raw materials for paper pulp, it becomes possible to replace import of wood raw materials, to save foreign currency, to increase rural income, and to make high quality paper.

What is claimed is:

1. A method for preparing pulp from cornstalks comprising the steps of pulverizing cornstalks, cooking, washing, screening, thickening, and beating, wherein the cooking step is performed with a liquid ratio (wt/wt) of an aqueous reagent solution to a cornstalk material being 3:1 to 6:1, at a reaction temperature of 120–200° C. for 1.5 to 4 hours, and the aqueous reagent solution is $NaOH+Na_2SO_3+Na_2CO_3+$ anthraquinone.

2. The method as claimed in claim 1, further comprising the step of bleaching the pulp.

3. The method as claimed in claim 1, wherein, based on the total weight of the pulp, 20–80 wt. % of herbaceous pulp or recycled pulp is added in addition to wood pulp and cornstalk pulp.

4. The method as claimed in claim 1, wherein a polyvinylalcohol or polyacrylamide is further added to the pulp.

5. The method as claimed in claim 1, wherein an additive selected from the group consisting of a starch, strength enhancing agent, fiber expansion agent, fluorescent whitening agent and polymer electrolyte is further added to the pulp.

* * * * *